US006334402B1

(12) United States Patent
Gilligan

(10) Patent No.: US 6,334,402 B1
(45) Date of Patent: Jan. 1, 2002

(54) FOLDING BOAT

(75) Inventor: Patrick Gilligan, Ile Perrot (CA)

(73) Assignee: Bombardier Inc., Montreal (CA)

( * ) Notice: Subject to any disclaimer, the term of this patent is extended or adjusted under 35 U.S.C. 154(b) by 0 days.

(21) Appl. No.: 09/593,527

(22) Filed: Jun. 14, 2000

(30) Foreign Application Priority Data

Jun. 14, 1999 (CA) ..... 2274439

(51) Int. Cl.[7] ..... B63B 7/00
(52) U.S. Cl. ..... 114/354; 114/345
(58) Field of Search ..... 114/345, 352–354, 114/77 A, 77 R, 55.5; 440/38

(56) References Cited

U.S. PATENT DOCUMENTS 4,320,713 A * 3/1982 Nishida et al. ..... 114/123
5,544,607 A * 8/1996 Rorabaugh et al. ..... 114/123

OTHER PUBLICATIONS

"Sea Doo Doin' Jet Power Best", Bombardier Inc., Aug. 1995.
Explorer 5821 Parts Catalog, 219 800 014, Mar. 1994.
Zodiac Brochure—Zodiac 1990, Collection Semi–Ridges (One Page).
Bombardier Brochure—Sea–Doo JetBoats 1997 Parts Catalog, No. 219 300 410, 1997 (Copy of front cover; copy of back cover).

* cited by examiner

*Primary Examiner*—Ed Swinehart
(74) *Attorney, Agent, or Firm*—Pillsbury Winthrop LLP

(57) ABSTRACT

The present invention provides a foldable boat comprising a first rigid hull section having a bottom that is substantially V-shaped in transverse section, and a second rigid hull section hinged to the first rigid hull section, wherein an axis of the hinge is longitudinal. The foldable boat may further comprise an inflatable tube generally disposed above said first and second hull sections and extending rearwardly from a bow of the boat along opposite sides of the boat, a third rigid hull section hinged to the first rigid hull section, wherein an axis of the hinge is longitudinal and the third section is mounted on an opposite side of the first section from the second hull section such that the first section forms a center section and the second and third sections respectively form port and starboard sections, the second and third sections respectively forming upper edges of the V-shape. The hinges of the second and third hull sections are designed to permit the second and third hull sections to be folded upward from an unfolded state into a folded state, thereby significantly reducing the storage width of the boat relative to the unfolded state. The second and third sections lay on top of the first section when in the folded state. A latching mechanism is used for locking the second and third hull sections to the first hull section in the unfolded position. The boat is powered by a jet propulsion system integrally mounted in the first hull section.

21 Claims, 16 Drawing Sheets

FOLDING BOAT

CROSS-REFERENCE

This application relies on Canadian Application No. 2,274,439, filed Jun. 14, 1999, (including its specification, drawings, and photographs) for priority. That application is hereby incorporated by reference into this application.

FIELD OF THE INVENTION

The present invention relates to folding semi-rigid inflatable boat.

BACKGROUND OF THE INVENTION

Amphibious aircraft (i.e. aircraft that are capable of landing and taking off from land or from water) are especially useful for the coast guard's search-and-rescue (SAR) operations and other types of marine operations. In order to access a sinking or stranded vessel, the coast guard ideally would like to have a boat that can be deployed from such an aircraft. In that way, the coast guard can reach the vessel in distress rapidly by plane and then deploy personnel into a boat launched from the plane for water operations.

Several potential solutions exist for transporting boats in aircraft. For example, a boat may be carried externally on the aircraft. The primary shortcoming with this method of carrying a boat is that the boat creates aerodynamic drag and interferes with the desired airflow over the wings and control surfaces. Also, the externally-mounted boat is susceptible to coming loose (which is potentially catastrophic during flight).

A second method of transporting a boat is to carry the boat inside the fuselage. This precludes any of the foregoing problems. However, the boats that are transported inside the fuselage are bulky and make it difficult for personnel to embark and disembark on the boat from the plane (see FIG. 1). As shown in FIG. 1, a conventional inflatable or semi-rigid boat 2 (one type of which is often referred to as a Zodiac® boat) is too bulky to fit inside the fuselage of a SAR amphibious aircraft 100 without significantly interfering with passenger travel in the cramped cabin.

A further problem exists in that conventional rigid boats are bulky and difficult to fit into the confined space available in amphibious aircraft. One potential solution is to use inflatable pontoon boats that are only inflated when needed and can be stored inside the amphibious aircraft in a relatively small space when deflated. Unfortunately, because conventional inflatable boats are flat-bottomed, they become very unstable in choppy water and are at the mercy of side winds, which easily blow them off course. Such instability is especially undesirable in the SAR field where lives may depend on the rescue boat's ability to quickly maneuver to and from the rescue site.

Rigid inflatable boats (RIB) exist having inflatable gunwales and a rigid V-shaped hull. However, even in the deflated state, such boats are extremely bulky and not practical for use in SAR aircraft. U.S. Pat. No. 4,597,355 discloses a RIB having a transversely hinged two part hull. However, because the RIB only folds laterally, the width is not decreased. In aircraft, whose fuselages are much longer than they are wide, reducing the storage width of the boat is essential. This deficiency is not addressed either by the '355 patent specifically or the prior art generally.

SUMMARY OF THE INVENTION

It is thus an object of the present invention to provide a boat which can be quickly and easily deployed from the relatively confined space of an aircraft or amphibious aircraft fuselage.

It is a further object of the present invention to provide a rigid-hulled boat for launching and recovery from inside an aircraft.

It is a further object of the present invention to provide such a boat which can be deployed from an amphibious aircraft in rough waters.

It is a further object of the present invention to provide such a boat which has an integral jet propulsion unit.

The present invention solves the above-identified problems by providing a rigid-hulled, foldable boat comprising a first rigid hull section having a bottom that is substantially V-shaped in transverse section, and a second rigid hull section hinged to the first rigid hull section, wherein an axis of the hinge is substantially parallel to the longitudinal center-line of the boat.

The foldable boat may further comprise an inflatable tube generally disposed above said first and second hull sections and extending rearwardly from a bow of the boat along opposite sides of the boat.

A third rigid hull section also may be hinged to the first rigid hull section, wherein an axis of the hinge is longitudinal and the third section is mounted on an opposite side of the first section from the second hull section such that the first section forms a center section and the second and third sections respectively form port and starboard sections, the second and third sections forming upper edges of the V-shape.

It is a further object of the present invention to provide a construction where the hinges of the second and third hull sections permit the second and third hull sections to be folded upward from an unfolded state into a folded state, thereby significantly reducing the storage width of the boat relative to the unfolded state.

Another object of the present invention is to provide a boat where the second and third sections lay on top of the first section when in the folded state.

It is still another object of the present invention to provide a latching mechanism for locking the second and third hull sections to the first hull section in the unfolded position.

Another object of the present invention is to provide a boat that is powered by a jet propulsion system integrally mounted in the first hull section.

Other objects and features of the invention will become apparent by reference to the following description and the drawings.

BRIEF DESCRIPTION OF THE DRAWINGS

The various embodiments of the present invention is illustrated throughout the figures, in which:

FIG. 13(*b*) shows the motion of the latching mechanism of the first embodiment;

FIG. 13(*c*) shows a sectional view of the latching mechanism;

DETAILED DESCRIPTION OF THE PREFERRED EMBODIMENTS

Figure 1:
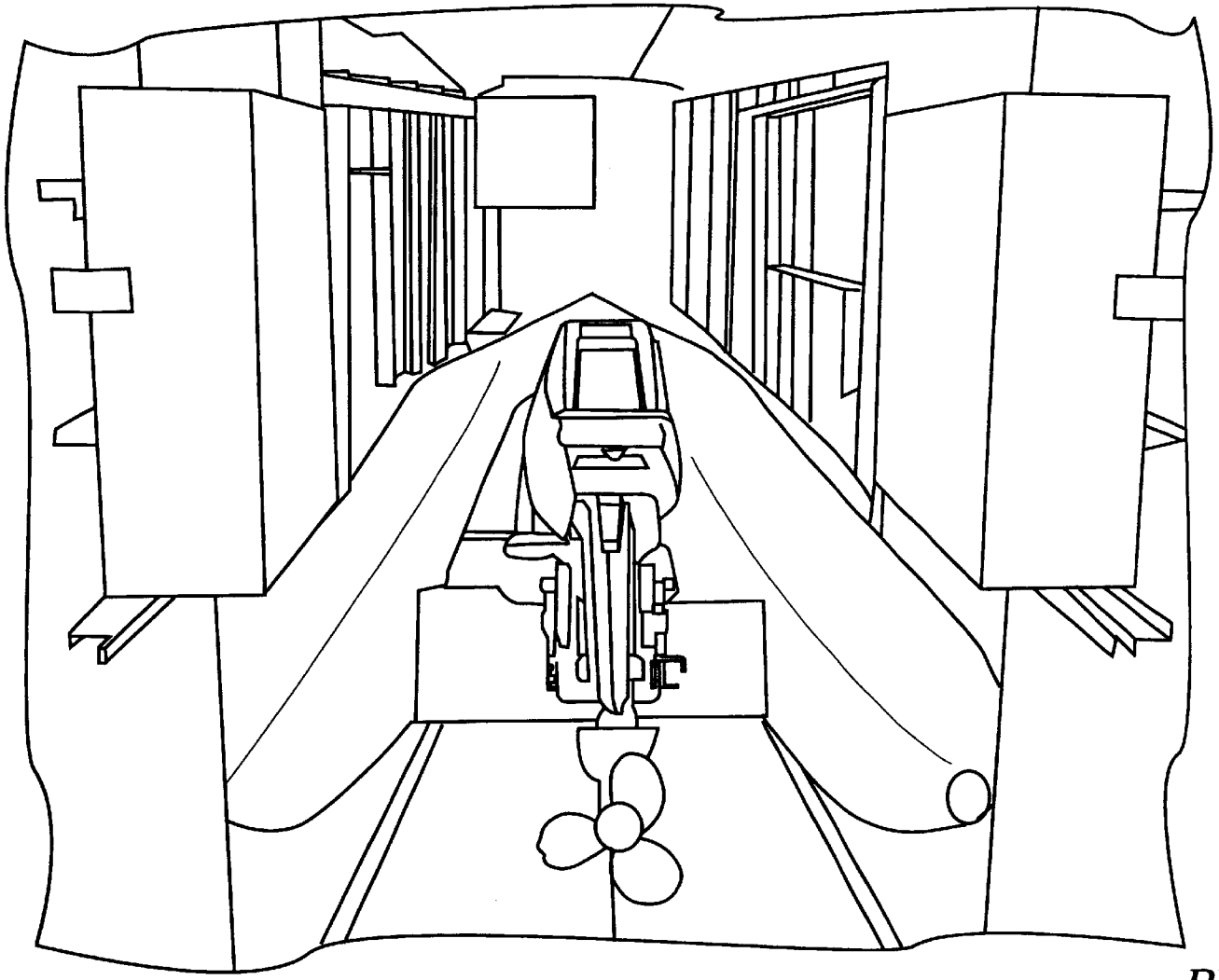
FIG. 1 PRIOR ART
FIG. 1 is a rear view of a prior art inflatable or semi-rigid boat illustrating how cramped the confines of the fuselage can be with a boat of that size.
Figure 2:
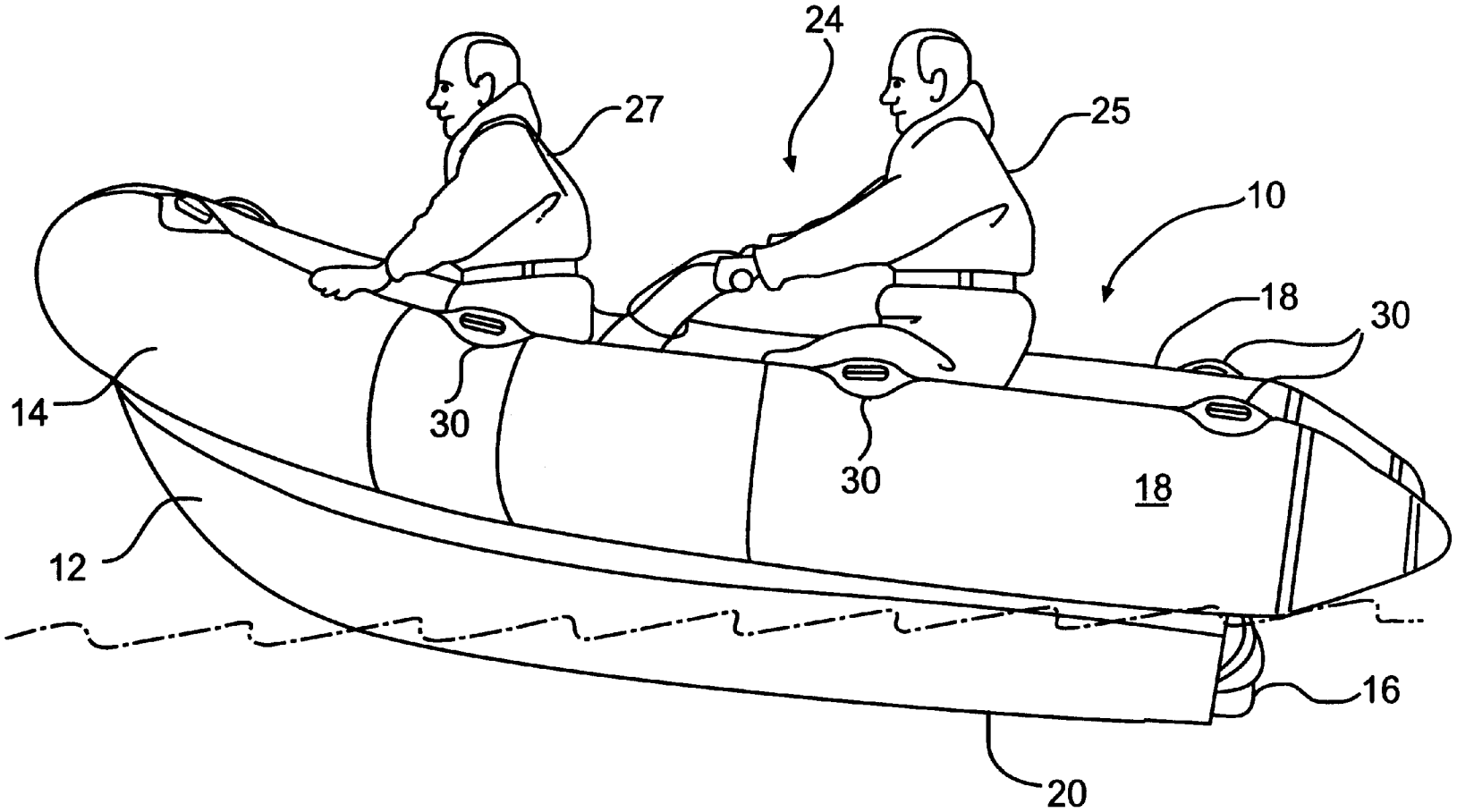
FIG. 2 is a side view of a folding boat in operation in accordance with a first embodiment of the present invention.

FIG. 2 illustrates a side view of the first embodiment of the present invention in operation. Folding jet boat 10 has a folding V-shaped hull 12 with an inflatable tube or collar 14. Since the boat 10 is designed to be light (in weight) and to occupy a small storage volume, the preferred embodiment of the boat 10 is designed to carry up to five persons or equivalent cargo (300 kg). If desired, however, the boat can be constructed to be larger than that illustrated. If made larger than the embodiment illustrated throughout the figures, the boat can be designed to accommodate a greater number of passengers and a larger quantity of cargo.

As shown in FIGS. 3 through 12, the folding jet boat 10 comprises two outer sponsons 18, a center main hull 20 equipped with an integral jet propulsion system 16, and removable fuel tank 22, which is described in greater detail below. The operator's station 24 is positioned on the main hull 20 toward the rear of the boat 10 and generally in the center of the boat 10 with respect to the port and starboard sides.

The operator's station 24 includes saddle-type seat 26 (which is also referred to as a "straddle-type" seat in some contexts) and a center handling steering column 28 for improved control and stability. The steering column 28 is foam-padded (like motorcycle handlebars) and has a thumb throttle. The boat operator 25 is seated on a foam covered saddle seat 26. Four passengers 27 (one of whom is illustrated in FIG. 2) can be seated on the collar 14 (the tube). Grab handles 30 are provided on the tube 14 so that the passengers 27 may stabilize themselves thereon.

Figure 8A:
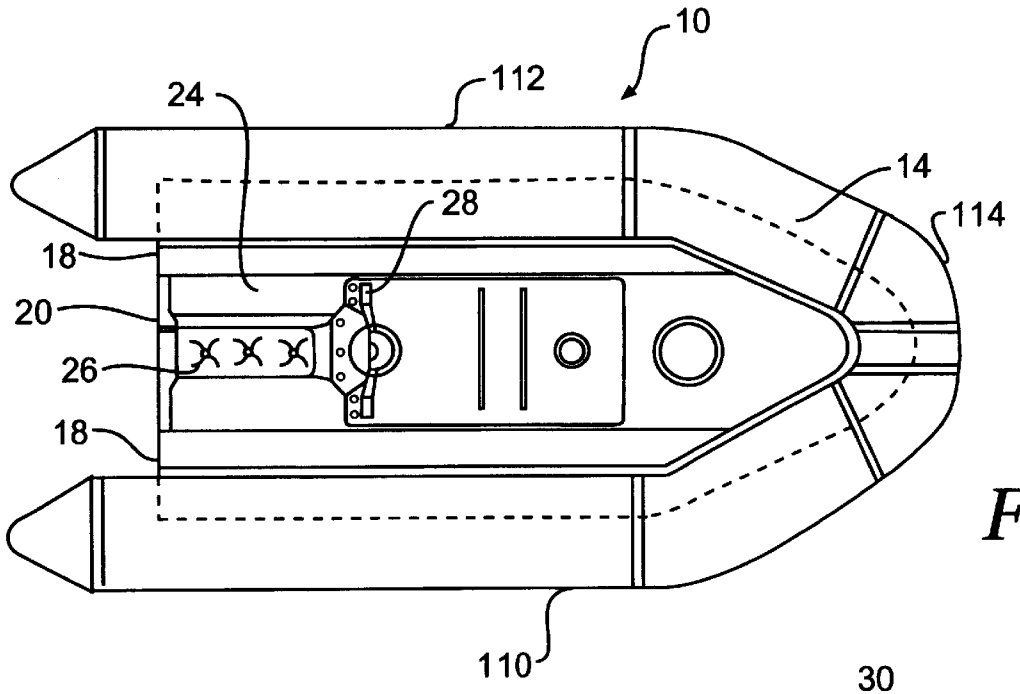
FIG. 8*a* is a top plan view of the boat according to the first embodiment.
Figure 8B:
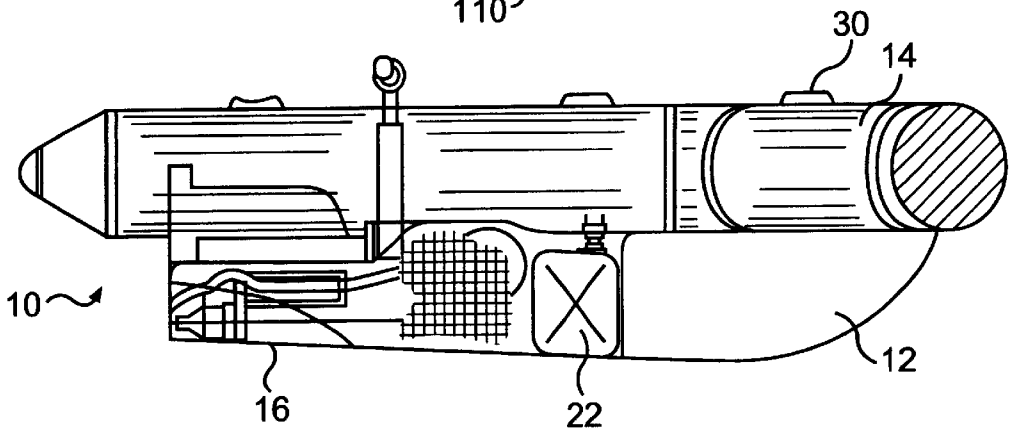
FIG. 8*b* is a side view of the boat according to the first embodiment.
Figure 9B:
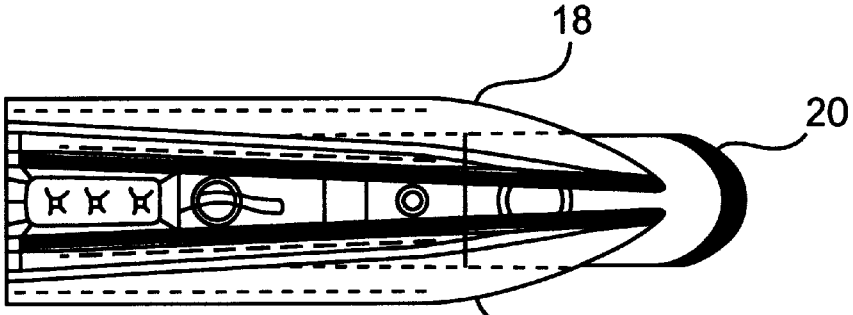
FIG. 9*b* is a top plan view of the boat of the first embodiment in its folded configuration.
Figure 9C:
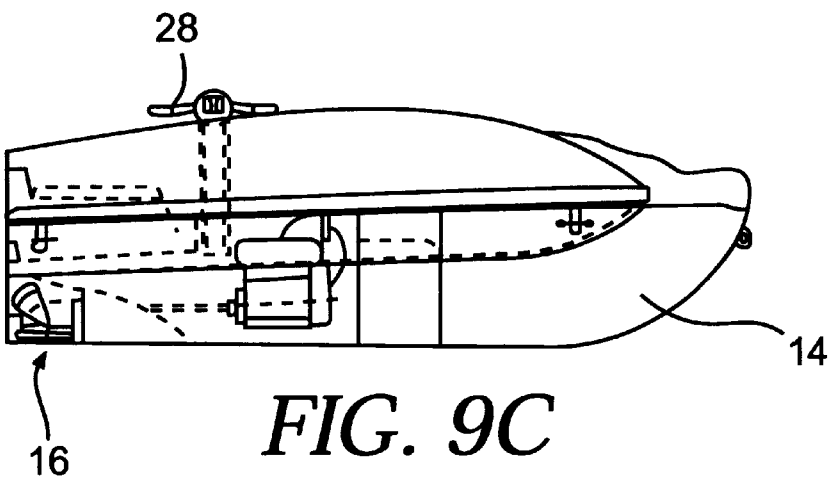
FIG. 9*c* is a side view of the boat of the first embodiment in its folded configuration.
Figure 9A:
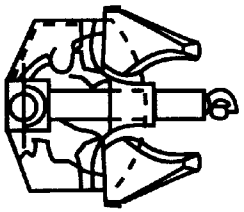
FIG. 9*a* is a front view of the boat of the first embodiment in its folded configuration.
Figure 10:
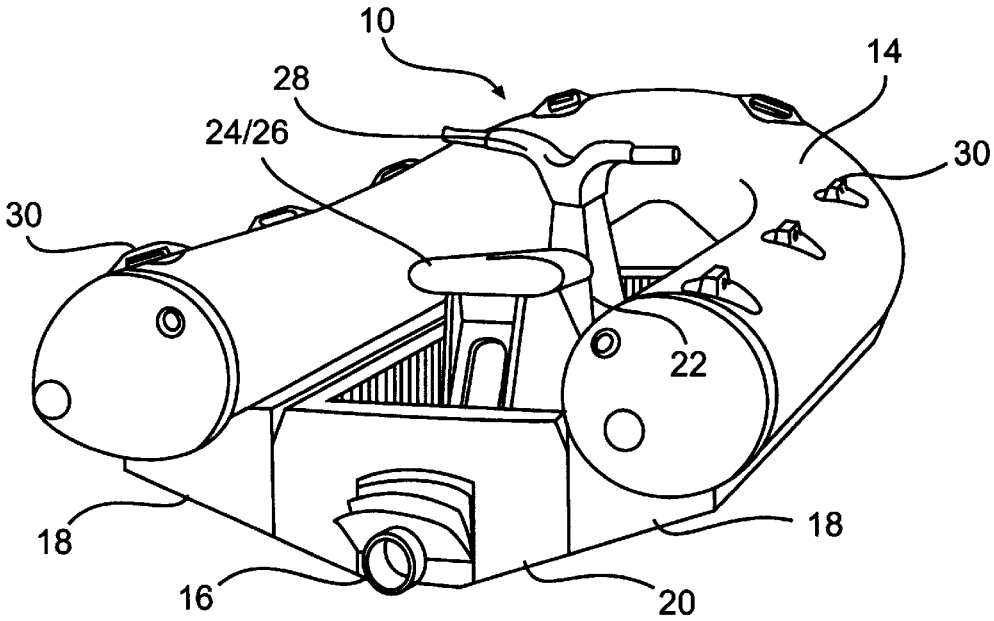
FIG. 10 is a rear perspective view of the boat in its unfolded and inflated state.
Figure 11:
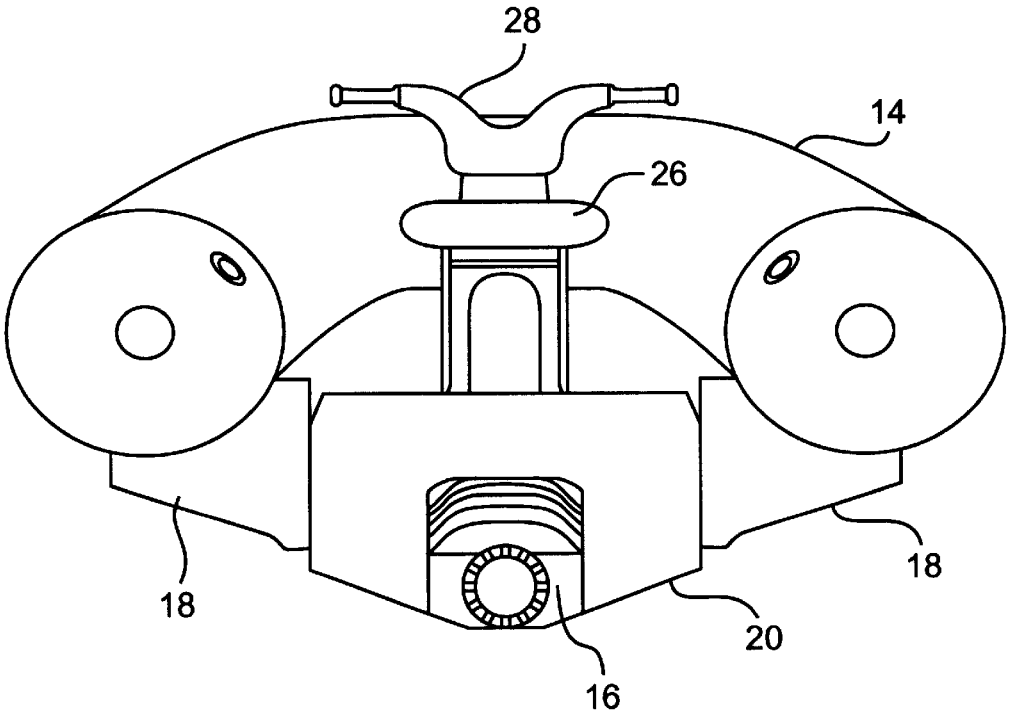
FIG. 11 is a rear view of the boat in its unfolded and inflated state.

While the straddle-type seat 26 illustrated in FIG. 8*a* is designed primarily only for the driver 25 of the boat 10, it is contemplated that the seat 26 could be designed to accommodate a second rider. Alternatively, if desired, the seat 26 could be designed to accommodate more than two riders. In addition, where the boat 10 is designed to hold more passengers and cargo than the embodiment illustrated, more than four passengers may be accommodated on the collar 14.

The main hull 20 and sponsons 18 are made from lightweight long-lasting, impact-resistant materials. For example, the center hull 20 and sponsons 18 may be fabricated from fiberglass such that the boat 10 is light, strong and easy to maintain and repair. The proposed maximum weight of the preferred embodiment of the boat 10 is 600 lb. (without oil and fuel).

The sponsons 18 are filled with foam, making the boat 10 difficult to sink in most expected environmental conditions. In fact, in the preferred embodiment, the boat 10 is considered to be unsinkable because of the quantity of foam that can be accommodated in the sponsons 18.

FIGS. 4, 6, 7, 9*a*, 9*b* and 9*c* illustrate the boat in its folded state. FIGS. 2, 5, 8*a*, 8*b*, 10, and 11 show the boat 10 in its unfolded state. The outer sponsons 18 are hingedly connected to the center hull 20 by hinges 40. To fold the boat 10 into its folded state from its unfolded state, the sponsons 18 are pivoted upwardly and inwardly over the center hull 20, as illustrated by the arrow in FIG. 3. This folding action significantly reduces the volume of the boat 10 such that the boat can be deployed, recovered and stored in a very confined space. In its folded and deflated state, the boat 10 is only 0.81 m (32 inches) wide, as opposed to the unfolded and inflated width of 1.8 m.

Figure 3:
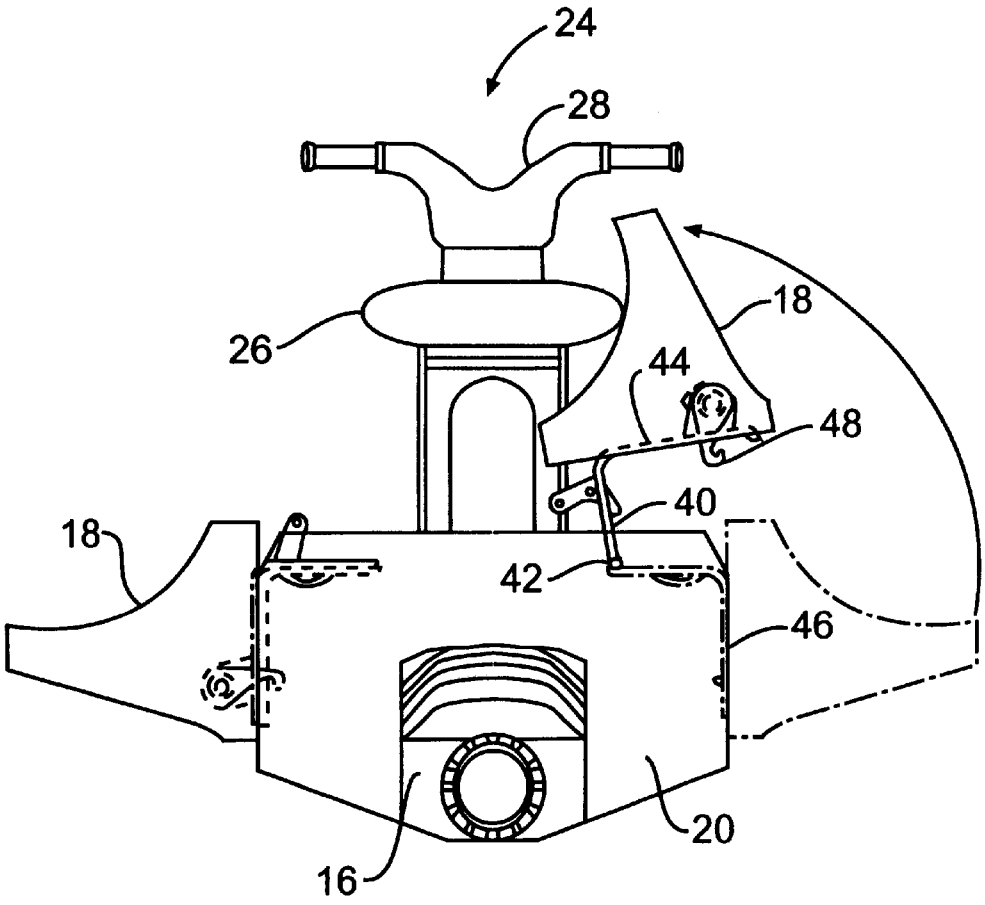
FIG. 3 is a rear view of the first embodiment showing the travel of the sponsons when folding.
Figure 4:
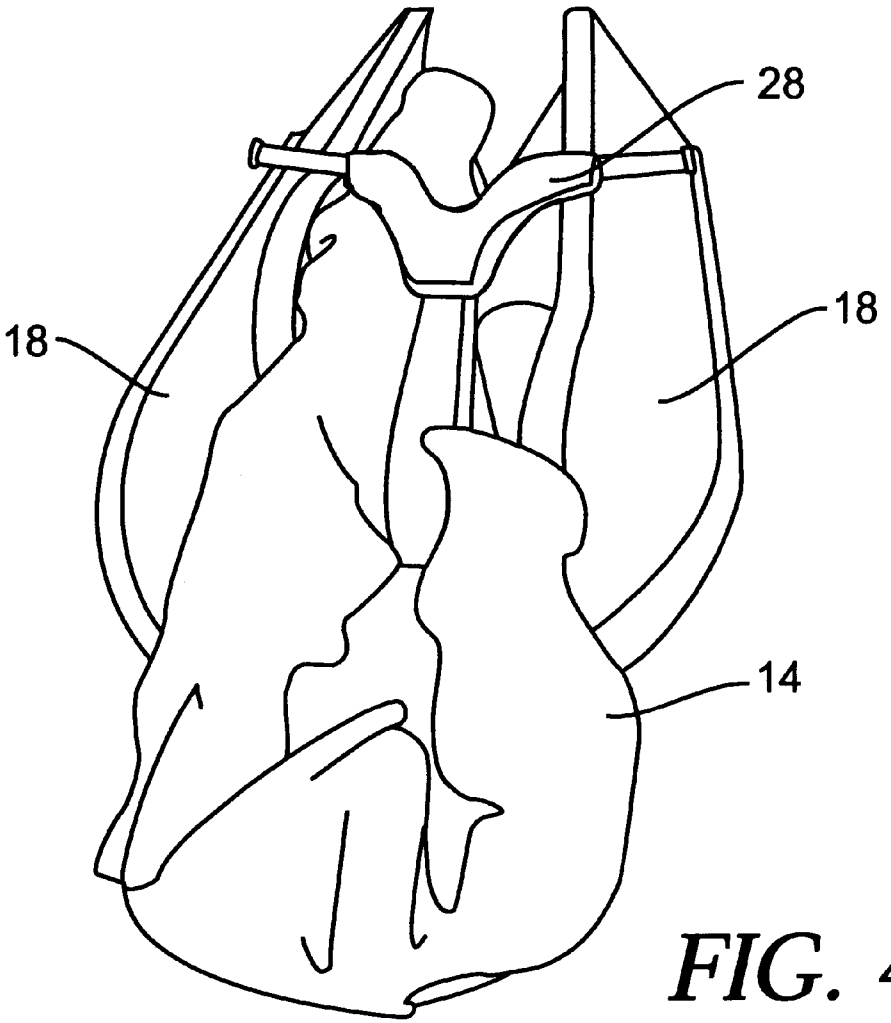
FIG. 4 is a front perspective view of the first embodiment in its folded configuration.
Figure 5:
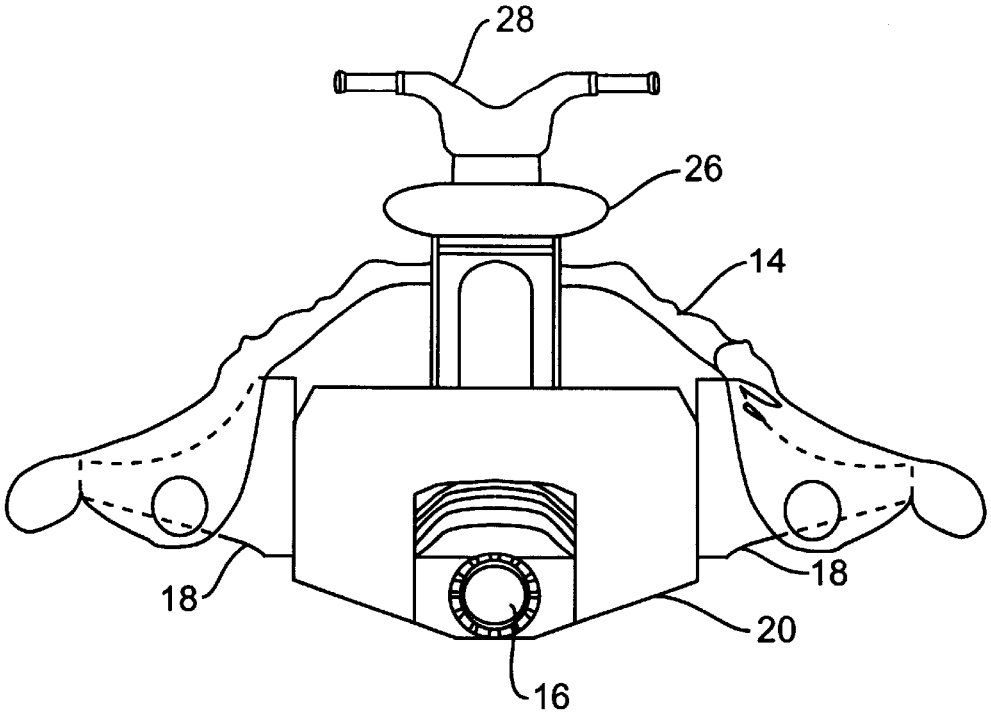
FIG. 5 is a rear view of the boat of first embodiment in its unfolded and uninflated configuration.
Figure 6:
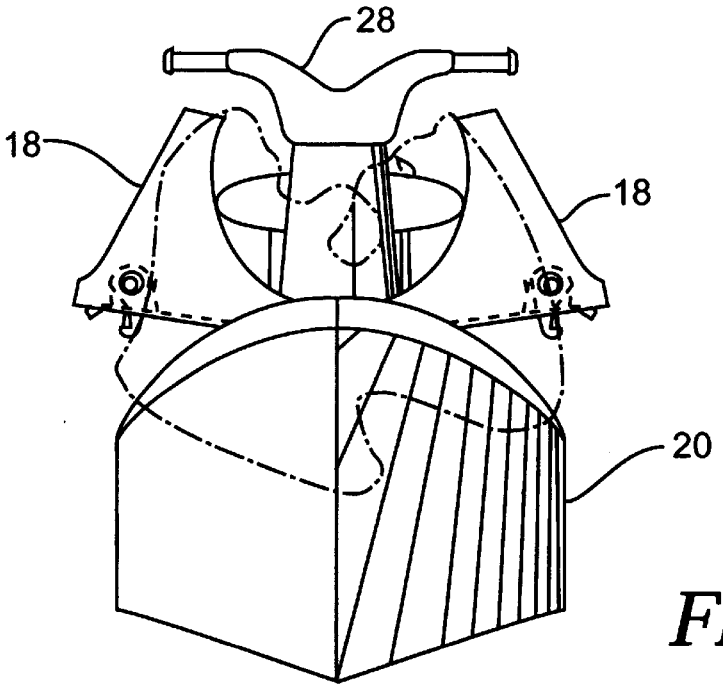
FIG. 6 is a front view of the first embodiment in its folded configuration.
Figure 7:
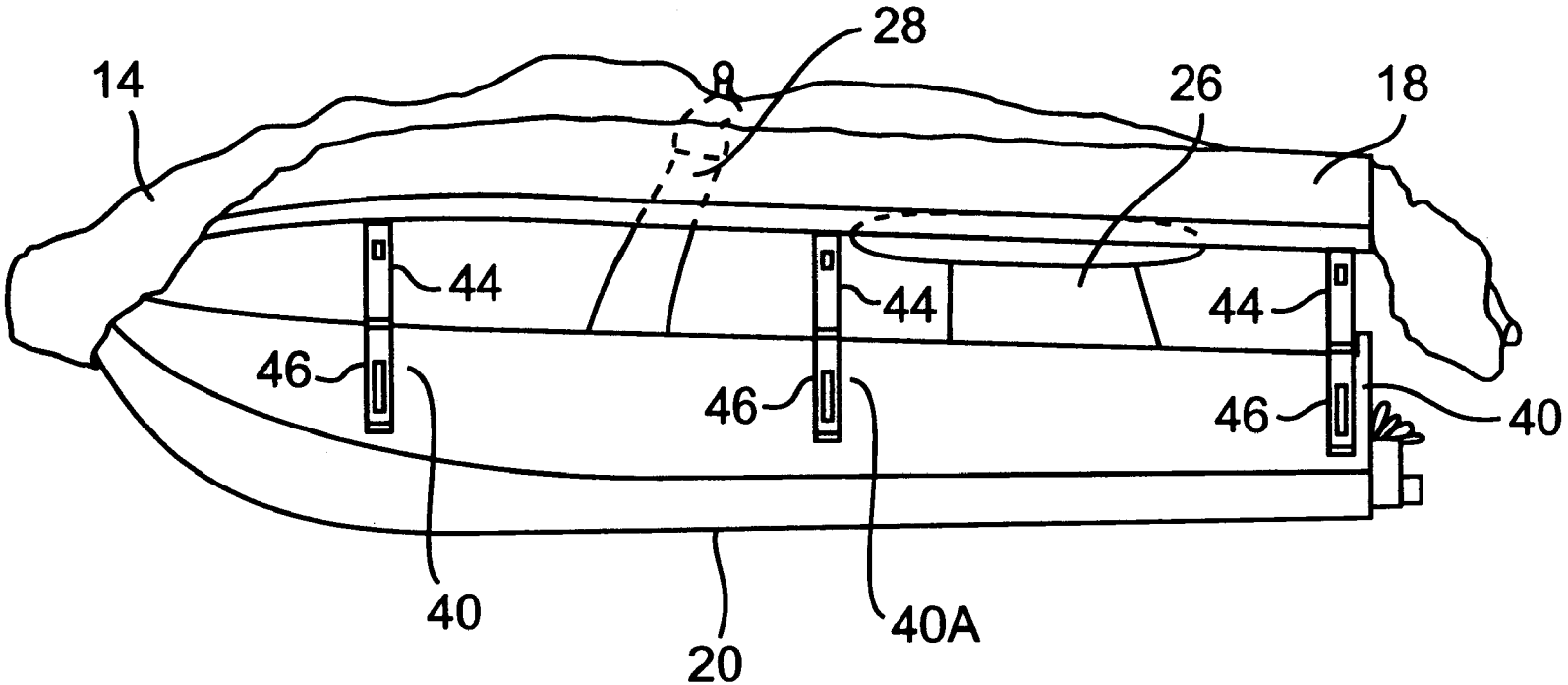
FIG. 7 is a side view of the first embodiment in its folded configuration.
Figure 13A:
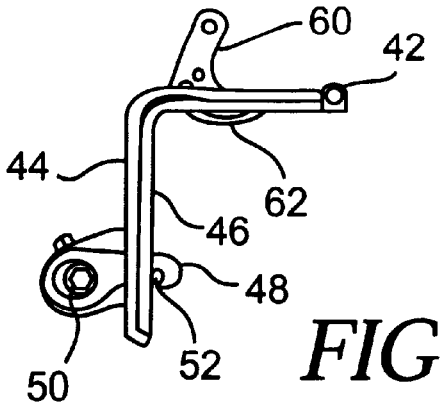
FIG. 13(*a*) is a rear view of the latching mechanism of the first embodiment.
Figure 13B:
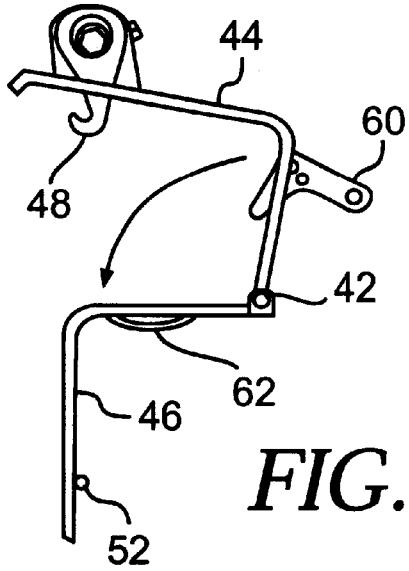

The hinges 40 will be described with reference to FIGS. 3, 7, and 13. Hinge portions 44, 46 of the hinges 40 pivot, relative to each other, about pivot pin 42 (see FIG. 13). A first hinge portion 44 is attached to the sponson 18 while a second hinge portion 46 is attached to the center hull 20 (see FIG. 7). A rotating, over-center locking hook 48 is pivotally mounted to the first hinge portion 44 and may be activated by rotating a torque rod 50 to positively engage the hook 48 with a bar 52 attached to the second hinge portion 46 (see FIG. 13).

Slots 44*a*, 46*a* are provided in the hinge portions 44, 46 to permit the free rotation of the hooks 48. When engaged, the locking mechanism rigidly connects sponsons 18 to the center hull 20 in the unfolded position so that sponsons 18 remain tightly engaged against the sides of the center hull 20. In the preferred embodiment, three hinges 40 are used for each connection of a sponson 18 to the center hull 20 (see FIG. 7). However, a greater or fewer number of hinges 40 may be employed in alternative embodiments of the boat 10, as required.

The hinges 40 are L-shaped, which places the pivoting point above the center hull 20 slightly inward from the contact point between sponson 18 and center hull 20. In the folded position, the sponsons 18 rotate both upward and inward to a folded state in which the sponsons 18 are directly above one side of center hull 20.

The folding mechanism will now be described with reference to FIGS. 7 and 13. Because of the effect of gravity thereon, a great deal of rotational force is required to rotate the sponsons 18 upward from their unfolded state.

Figure 13C:
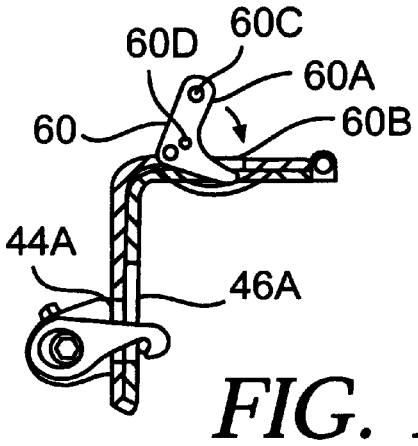

Accordingly, to assist in rotating the sponsons 18 into their folded state, a lifting lever 60 is pivotally mounted to the first hinge portion 44 of the center hinge 40*a* on each side of center hull 20 at pivot point 60*d*. The lifting lever 60 has a handle portion 60*a* and a leverage portion 60*b*, which slides along lifting brace 62. Lifting brace 62 has a curved shape and is mounted to second hinge portion 46. As shown in FIG. 13*c*, as handle portion 60*a* is rotated clockwise (direction of the arrow), leverage portion 60*b* pushes against lifting brace 62, transfers that lifting force to first hinge portion 44, and lifts and rotates sponson 18. Lifting lever 60 can be operated manually because of the mechanical advantage created. An unfolding mechanism is not required because the boat 10 unfolds under its own weight (due to gravity).

In the manually-operated embodiment, there are two torque rods (not shown), one in each of the outer hulls. These rods are rotated manually in opposite directions to one another. This action rotates and engages the locking hooks 48 into the center hull hinge 40. These locking hooks 48 rotate around their longitudinal axes.

In a second embodiment of the present invention, the torque rods 50, which lock the hooks 48 into the locked position, are replaced by push-pull rods (not shown) that accomplish the same result of locking and unlocking the hooks 48. The push-pull rods will push or pull the locking hooks 48. In this embodiment, the locking hooks 48 will be repositioned and will rotate around their new vertical axes. In addition, it is contemplated in this second embodiment that the locking mechanism will be located outside of the outer hulls.

In a third embodiment of the present invention, the manually-operated hand lever can be replaced by either an electric winch or a hydraulic pump with a cylinder to fold the boat 10. Where an electric winch or hydraulic pump are incorporated into the design as the primary folding mover, a manually operated mechanical hand crank is contemplated as a back-up.

Hole 60*c* is provided at the top of lifting lever 60 for attachment to the electric winch or hydraulic pump (not shown). A cable from the electric winch can be attached to hole 60*c* so that the folding process may be done automatically, thereby simplifying the recovery and consolidation of the boat 10. Similarly, where a hydraulic pump is contemplated to assist in folding the boat, the push-pull rods connected to the pistons may be attached to holes 60*c*. Whichever folding mover is used to actuate the folding mechanism, the operator simply unlocks the sponsons' hinges 40 and activates hydraulic pump(s) or electric actuator(s) which cause the sponsons 18 to pivot and fold over top of the center hull 20.

Figure 16:
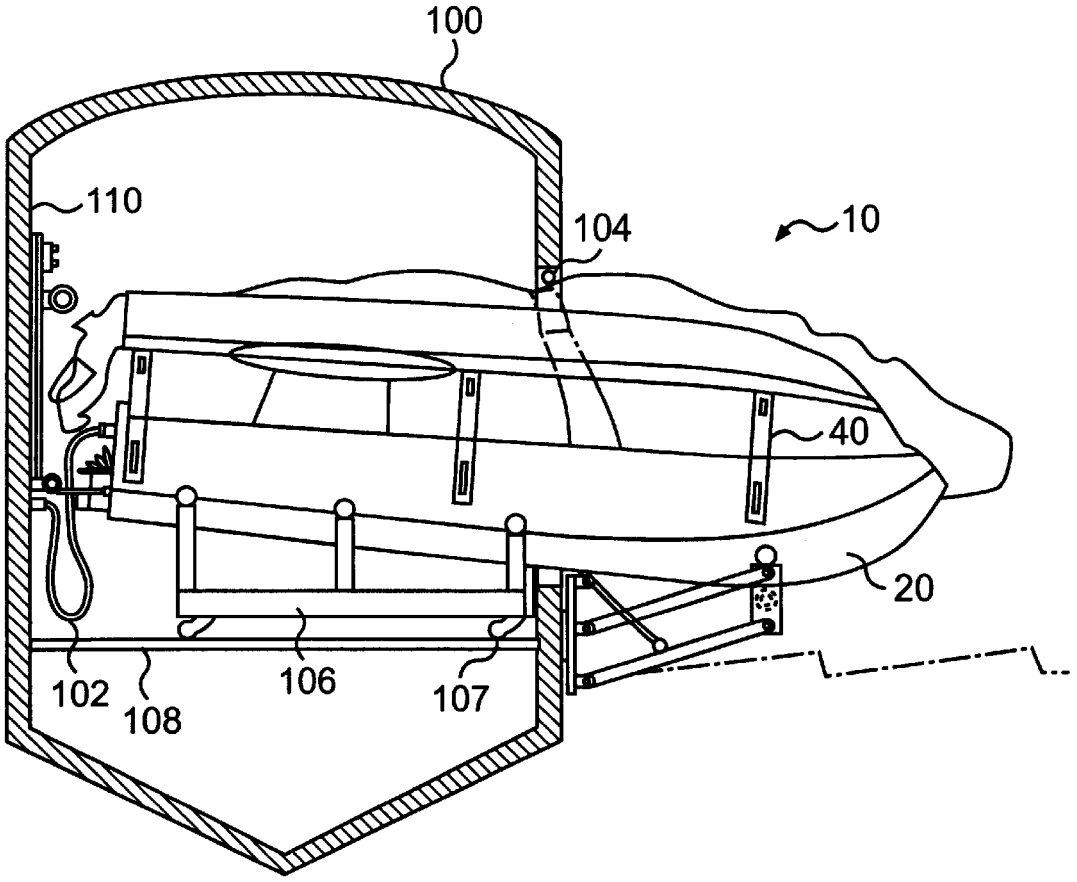
FIG. 16 is a front sectional view of the folding boat of FIG. 1 on its launching rails according to the first embodiment.

The inflatable, multi-chambered collar 14 increases flotation and stability of the boat 10 while improving boat and passenger protection. As shown in FIG. 16, in the preferred embodiment of the present invention, the inflation of the collar 14 is achieved with an air tank/hose 102 equipped with a 3 psi regulator located onboard an amphibious aircraft 100. When incorporated into the present invention, the single hose 102 can include a quick-connect/disconnect fixture, as would be understood by those skilled in the art.

Deflation of the boat 10 is achieved by opening large bleed valves 105 so that the deflation can be accomplished quickly and the recovery time kept to a minimum. An electric vacuum system provided in the aircraft 100 also can be used to decrease deflation time and simplify operation.

A minimum of three chambers 110, 112, 114 (located at the starboard, port, and fore sides of the boat 10) are incorporated into the tube 14 in the preferred embodiment of the present invention. Alternatively, a smaller or greater number of chambers may be incorporated into the tube 14. In the preferred embodiment, the boat 10 can carry a full load at 10 knots with only two of the three chambers in the tube 14 inflated.

In the preferred embodiment, an electric or motor driven air pump (not shown) with a regulator is also located on the boat 10 for self-inflation of the tube 14, when required. Alternatively, a pressurized gas cylinder may be substituted for the air pump to inflate the tube 14.

The boat 10 also includes provisions for transporting a stretcher 116 and for mounting the stretcher 116 with straps 118 across the bow of boat 10 for medical evacuation. Four rubber fitting 120 are positioned at the top of the inflatable tube 14. The rubber fittings 120 may be bonded to the inflatable tube 14 or they may be attached in any other suitable manner that would be known to those skilled in the art. The four rubber fittings 120 cradle the four ends of the stretcher 116 placed thereon. In the preferred embodiment, four nylon straps 118 secure the stretcher 116 to the rubber fittings 120. Alternatively, a greater or fewer number of rubber fittings 120 may be employed to secure the stretcher 116 to the boat 10. In addition, while the four fittings 120 are preferably rubber, any suitable alternative material may be used. Also, the securing straps 118 may be substituted for any other type of securing device, strap, or mechanism as would be understood by those skilled in the art.

Should the boat 10 tip over, a self-righting system also can be employed to rotate the boat to an upright position. To re-orient the boat 10 in an upright position, this system deflates one of the side chambers of tube 14, either manually or automatically. If manually operated, a pull handle can be located at a convenient position under the boat 10 (not shown). If automatic, a gravity activated check valve may be incorporated into the boat 10 to deflate one of the side chambers of the tube 14. With one of the side chambers deflated, the boat 10 may be more easily righted in the water.

In the preferred embodiment of the boat 10, the engine for the jet propulsion system 16 is a standard twin-stroke, twin cylinder Rotax® 717 (717 cc and 85 hp) ("Rotax" is a registered trademark of Bombardier, Inc., a Canadian corporation). Of course, any suitable motor with sufficient horsepower could be substituted therefor, and the motor may be either a two or four stroke motor. The propulsion system 16 is the standard Bombardier® Formula Jet Pump™ ("Bombardier" and "Formula Jet Pump" are both trademarks of Bombardier, Inc.) with bronze stator vanes that drives an axial flow, single stage impeller. However, as would be understood by those skilled in the art, any suitable propulsion system 16 could be substituted to practice the present invention.

The engine is mounted in center hull section 20 midway between the bow and stern. This arrangement enhances stability, maneuverability and speed, which are crucial when operating SAR vessels in rough seas. In the preferred embodiment, the maximum continuous speed of the boat 10 (with the Rotax® 717 engine) is 30 knots in normal sea conditions. In addition, the boat 10 is designed with an endurance of 2 hours at ⅔ wide open throttle (which equates to an approximate speed of 20 knots).

The use of a jet propulsion system 16 is preferable over an outboard motor because of the inherent dangers the outboard's propellers present to anyone nearby in the water. However, an outboard motor or other type of propulsion system also could be used in the present invention.

Figure 12:
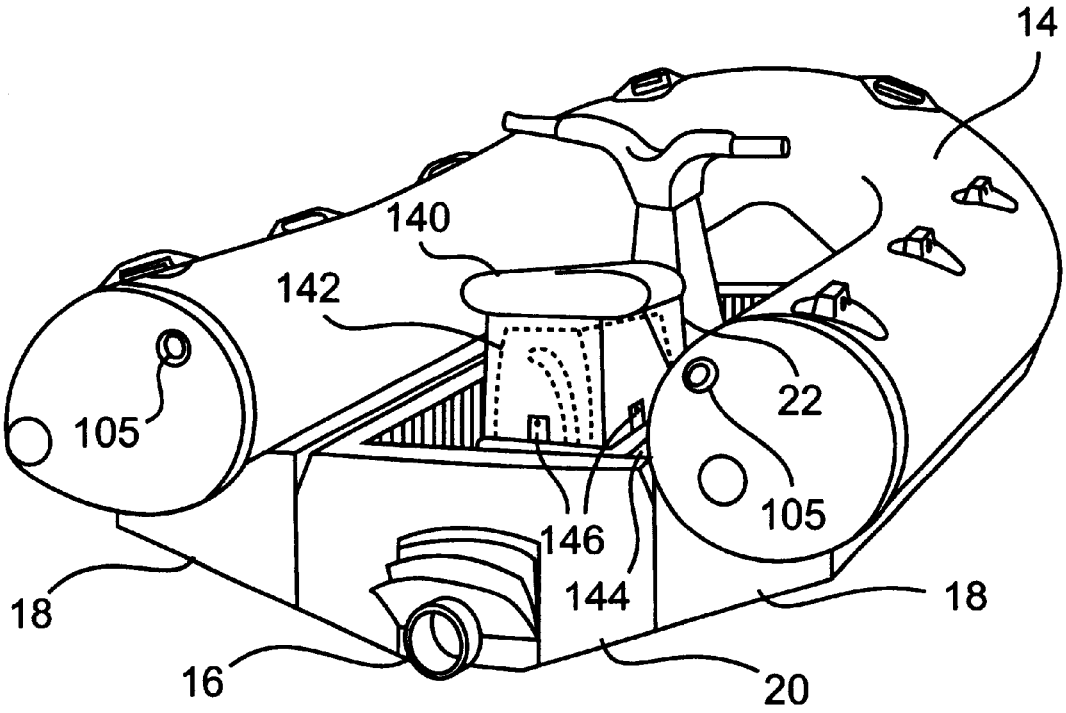
FIG. 12 is a rear view of the boat according to a fourth embodiment of the present invention.

FIG. 12 illustrates a fourth embodiment of the present invention, which is similar to the previous embodiments, except that saddle seat 26 of the first embodiment is replaced by removable saddle seat 140. In this embodiment, saddle seat 140 contains an integral fuel tank 142 (shown as a dotted outline). Removable saddle seat 140 fits into a positioning slot 144 in the deck of center hull section 20 and is held in place by clamps 146. Under conditions where it is necessary for the boat 10 to make repeated trips from aircraft 100 (or any other delivery vehicle) to the rescue area, it may be desirable to have the option to refuel the boat 10 very quickly. Accordingly, removable saddle seat 140 and fuel tank 142 can be quickly removed when empty by unclamping clamps 146 and lifting saddle seat 140. A second saddle seat 140 and fuel tank 142 that is full of fuel can then be easily placed in the slot 144 and clamped in position. This process minimizes interruption of the rescue operation. Fuel tank 142 may be used instead of the fuel tank 22 of the first embodiment. Alternatively, both fuel tanks 142, 22 may be used simultaneously to increase the boat's non-stop running time when endurance is required.

Fuel tank 22 may be fixed in the center hull 20 or it may be removable. If removable, fuel tank 22, when empty, may be replaced during a rescue operation with a full fuel tank 22 from aircraft 100 (or other suitable rescue vehicle). The removability and replaceability of fuel tank 22 can greatly enhance any rescue operation because it can greatly reduce the time need to refuel the boat 10.

Due to the deep V-shaped hull 12, the ride is smooth and secure even in rough waters (which is where coast guard units often venture). The V-shaped hull 12 also allows greater speed and maneuverability compared to flat-hulled boats. The combination of the deep V-shaped hull 12 and integral propulsion system 16 provides excellent rough water performance with the speed, maneuverability and reliability needed for open-sea operations.

Figure 14:
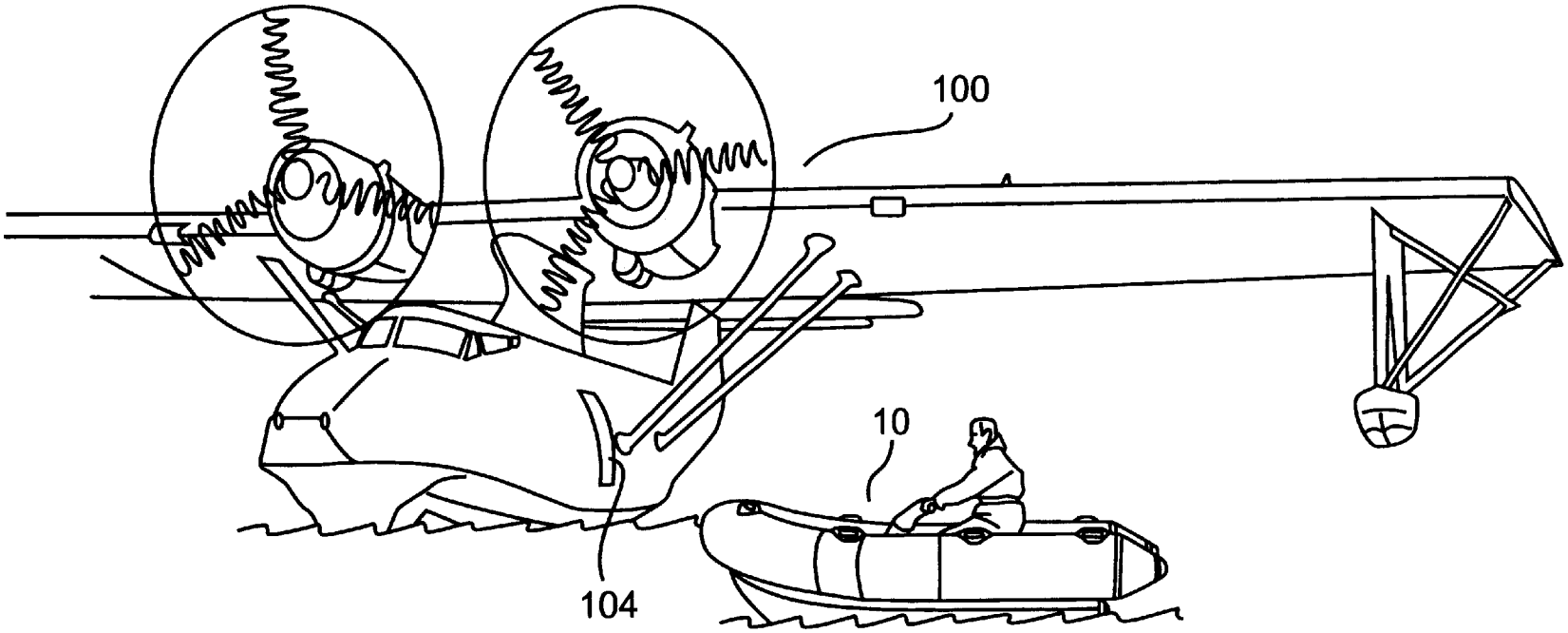
FIG. 14 shows the boat according to the present invention near an amphibious aircraft.
Figure 15:
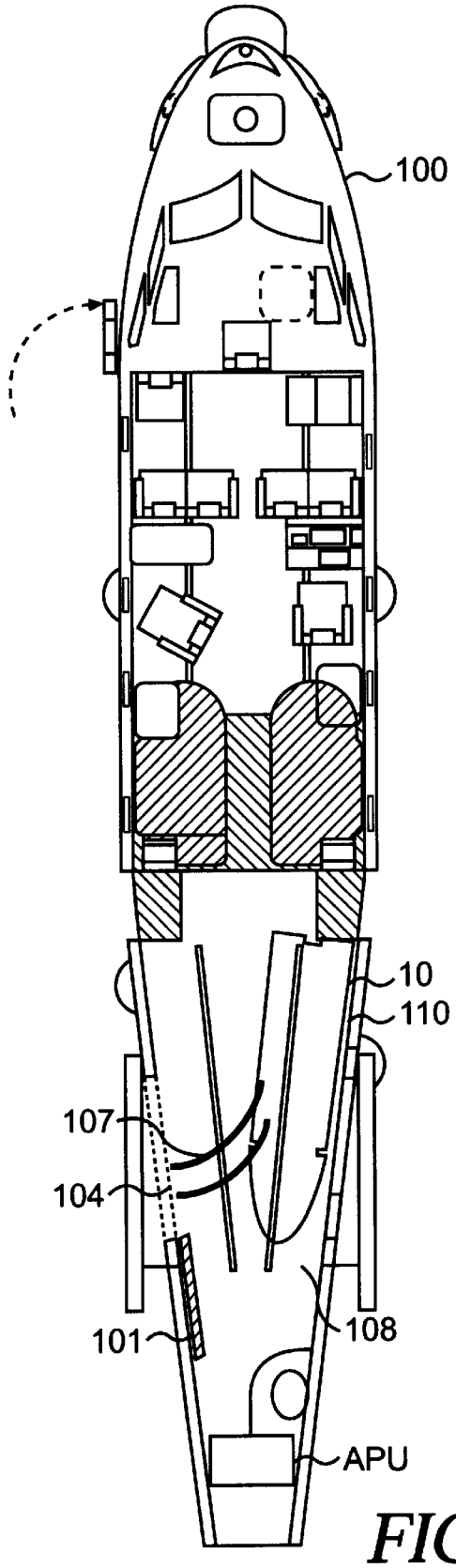
FIG. 15 shows a top view of the positioning of the folded boat in an amphibious aircraft.
Figure 17:
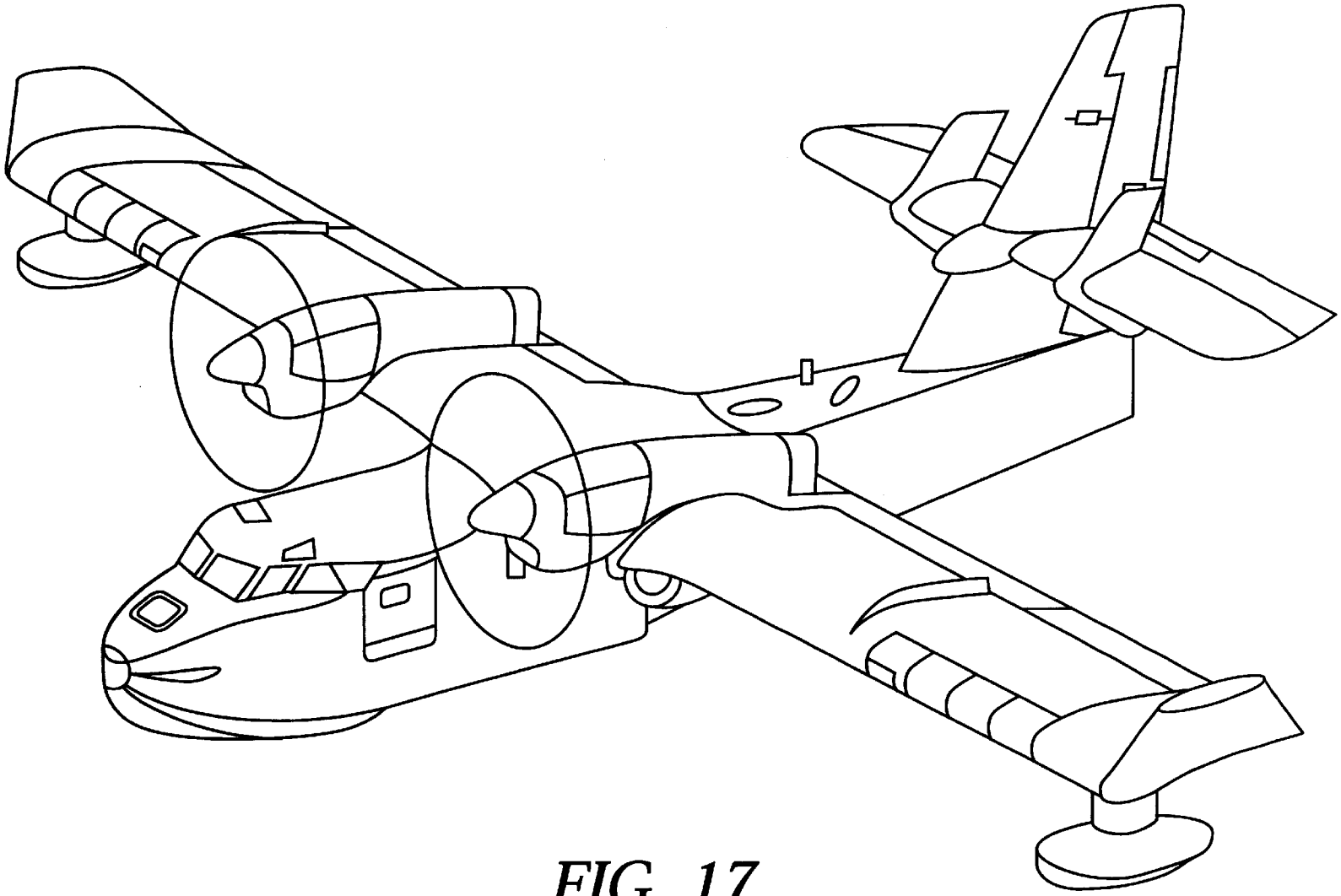
FIG. 17 is a perspective illustration of the Canadair® CL-415™ amphibious aircraft with which the present invention is contemplated for use.
Figure 18:
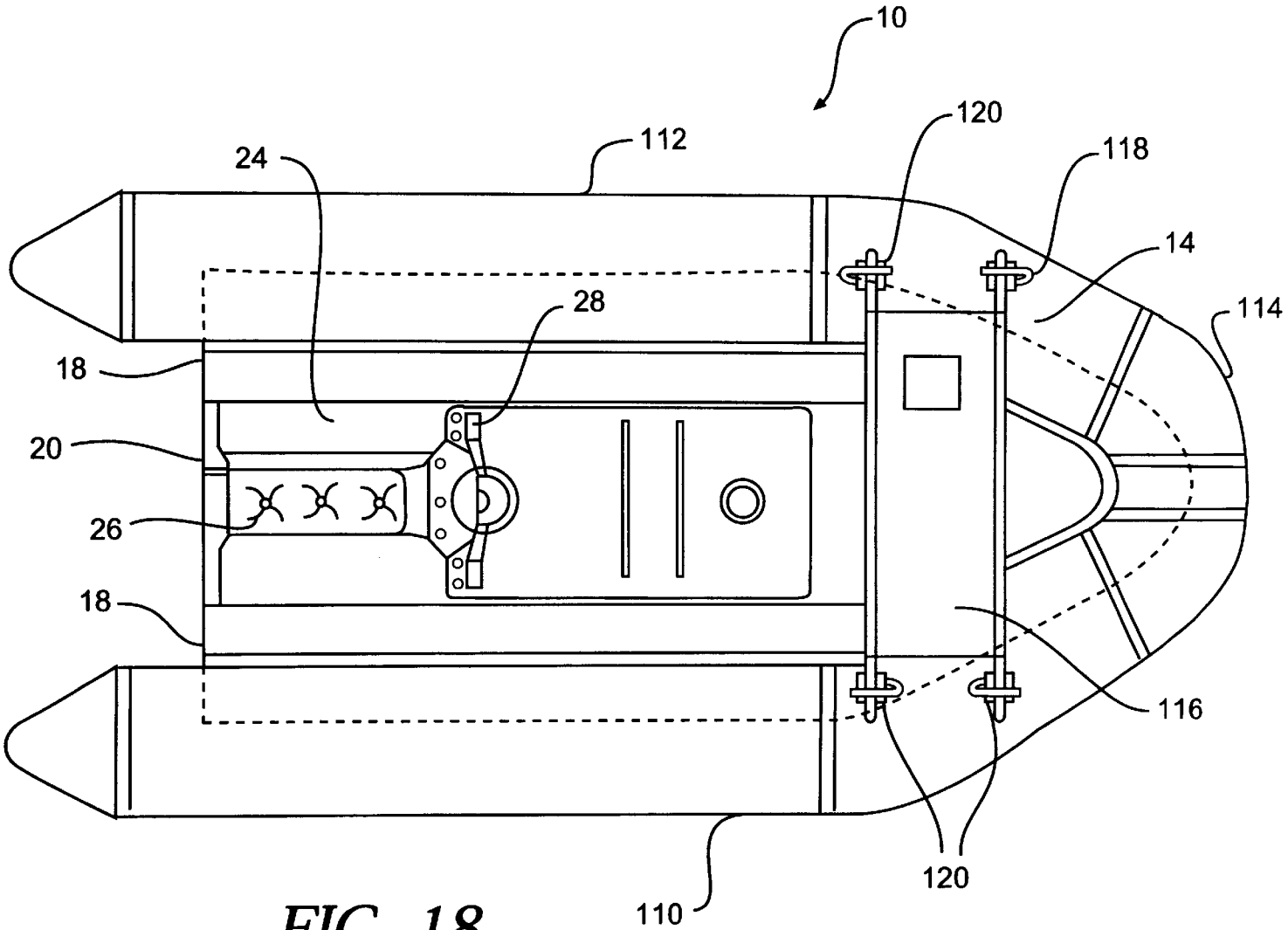
FIG. 18 is a top view of the boat of the present invention, illustrating one embodiment where a stretcher is positioned thereon.

Hereinafter, the deployment and retrieval system of the present invention will be described with reference to FIGS. 14 through 16. In the preferred embodiment, the folding boat 10 is designed for rapid deployment and retrieval an amphibious aircraft 100, such as the Canadair® CL-415™ SAR (Search and Rescue) ("Canadair" and "CL-415" are both trademarks of Bombardier, Inc.), for intervention in maritime operations. (The Canadair® CL-415™ is partially schematically illustrated in FIG. 15 and is illustrated in perspective in FIG. 17.) As shown in FIG. 15, the folding jet boat 10 can be easily stowed aboard the CL-415™ because of its compactness when folded. Due to the constrained width of the fuselage of the aircraft 100, the longitudinal folding of the boat 10 is especially desirable because it decreases the width of the boat 10 significantly, allowing relatively unimpaired use of the fore/aft passageway of aircraft 100. The folding jet boat 10 reduces its volume by more than half to facilitate storage and handling.

While the boat 10 is designed to be deployed from an amphibious aircraft 100 like the Canadair® CL-415™ SAR, it can also easily be deployed from any other type of aircraft. Alternatively, the boat 10 also can be deployed from a vehicle other than an aircraft. For example, boat 10 can also be deployed from a typical boat trailer in the conventional manner, should it be necessary to deploy the boat 10 from the shore of a body of water. It also could be lowered into the water from a truck using a cradle system similar to the one contemplated for the Canadair® CL-415™ SAR. In addition, the boat 10 could also be deployed from the deck of a larger boat, such as a coast guard cutter. It is also contemplated that the boat 10 could be dropped, in a container, from a helicopter where the boat 10 could be deployed after entry into the water.

When deployed the jet boat 10 is 3.8 m (12.5 feet) long, 1.8 m (5.9 feet) wide and 1.02 m high. When folded up, the boat has the same length and height but is only 0.81 m (32 inches) wide. The boat is presently capable of exiting and entering the aircraft 100 through the existing door 101 (1.12 m×1.02 m) or the larger cargo door 104 (1.07 m×1.52 m).

In the embodiment illustrated, launch and recovery of the boat 10 is accomplished with ease due to the unique integrated handling system onboard the Canadair® CL-415™. This is a dolly and rail system illustrated in FIGS. 15 and 16. The dolly 106 cradles the boat 10 and the guide rail 107, embedded in a floor platform structure, ensures proper alignment and facilitates ease of movement. When stored in the aircraft 100, the dolly 106 and boat 10 will be secured to the floor 108 and cabin sidewall 110. The floor platform 108 encases the rail assembly 107 so that the rail does not protrude above the platform's upper surface and to safely dispose of any water entering the cabin. To deploy boat 10, dolly 106 is rolled along rail assembly 107 from the storage location to the open cargo door 104. When deploying or recovering, the dolly 106 cradles the stern of boat 10 allowing the bow of boat 10 to be set into the water outside cargo door 102 where it is then unfolded and the tube 14 inflated.

Once deployed from aircraft 100, boat 10 is driven over to the people and/or equipment in need of rescue. The people are then loaded into the boat 10 and the boat 10 is driven back to the safety of the aircraft 100, where the people and/or equipment are unloaded into the aircraft 100. This process may be repeated, as necessary.

Because each of the hull sections are rigid and sponsons 18 are foam filled, the boat 10 will float even when the tube 14 is partially or completely deflated. This simplifies the deployment of the boat 10 because the boat 10 need not be fully unfolded and inflated until it is already in the water. Foam-filled sponsons 18 also make the boat safer because it is unsinkable.

Because of the compactness of the folded state of the boat 10, several boats 10 may be stacked one on top of another and/or one beside another in a container. The single container can then be taken to the site where use of several boats 10 is required. At the site, the individual boats 10 can then be deployed. This application is especially useful in situations involving the rescue of numerous people such as during large-scale floods. Packaged in a single container, numerous boats 10 can be quickly and easily brought to the flood site and deployed. Similarly, up to six boats 10 (or even more depending on the type of aircraft) may be stored and transported on a single aircraft pallet.

While the boat 10 had been described in relation to its usefulness as a rescue vehicle, it should be understood that boat 10 could be employed for many alternative uses. For example, the boat 10 could be used in military operations or it could be used by local police who are required to patrol local waters. Regardless of its ultimate use, the benefit of the boat 10 is that it may be stored in a smaller space than boats with V-shaped hulls that are known in the prior art.

The above description and drawings are illustrative only because modifications could be made without departing from the present invention, the scope of which is to be limited only by the following claims.

What is claimed is:

1. A foldable boat comprising:

a first rigid hull section having a bottom that is substantially V-shaped in transverse section, the first rigid hull section defining a longitudinal axis from bow to stern;

at least one second rigid hull section hinged to the first rigid hull section, wherein an axis of rotation therebetween runs longitudinally with respect to the boat; and an inflatable tube generally disposed above said first and second hull sections and extending rearwardly from a bow of the boat along opposite sides of the boat.

2. A foldable boat comprising:

a first rigid hull section having a bottom that is substantially V-shaped in transverse section, the first rigid hull section defining a longitudinal axis from bow to stern;

at least one second rigid hull section hinged to the first rigid hull section, wherein an axis of rotation therebetween runs longitudinally with respect to the boat;

a third rigid hull section hinged to the first rigid hull section, wherein an axis of rotation therebetween runs longitudinally with respect to the first hull section, wherein the third section is mounted on an opposite side of the first section from the second hull section such that the first section forms a center section and the second and third sections respectively form port and starboard sections, the second and third sections respectively forming upper edges of the V-shape; and an inflatable tube generally disposed above said first, second, and third hull section and extending rearwardly from a bow of the boat along opposite sides of the boat.

3. The foldable boat as claimed in claim 2, further comprising:

a plurality of hinges between the first hull section and the second and third hull sections, wherein the hinges permit the second and third hull sections to be folded from an unfolded state upward and inward into a folded state, thereby significantly reducing the storage width of the boat relative to the unfolded state.

4. The foldable boat as claimed in claim 3, wherein the second and third hull sections are disposed above the first section when in the folded state.

5. The foldable boat as claimed in claim 3, further comprising at least one latching mechanism for locking the second and third hull sections to the first hull section in the unfolded position.

6. The foldable boat as claimed in claim 2, further comprising a jet propulsion system integrally mounted in the first hull section.

7. The foldable boat as claimed in claim 2, further comprising a removable fuel tank in the first hull section.

8. The foldable boat as claimed in claim 2, further comprising a straddle seat mounted to the first hull section.

9. The foldable boat as claimed in claim 8, further comprising a handlebar steering device mounted to the first hull section directly forward of the straddle seat.

10. The foldable boat as claimed in claim 2, further comprising:

an automatic folding device that automatically folds the second and third sections from the unfolded state into the folded state.

11. The foldable boat as claimed in claim 2, wherein the second and third hull sections are foam filled so that the boat floats even if the inflatable tube is deflated.

12. The foldable boat as claimed in claim 3, further comprising:

a first lifting lever attached to one of the hinges attaching the second hull section to the first hull section; and a second lifting lever attached to one of the hinges attaching the third hull section to the first hull section, wherein said lifting levers are adapted to reduce a force required to begin to rotate the second and third hull sections upward from the unfolded state.

13. A method for deploying a foldable boat having a substantially V-shaped semi-rigid hull from an amphibious aircraft, comprising the steps of:

landing the aircraft on a body of water;

deploying the foldable boat through a hatch in the aircraft;

unfolding the boat upon deploying the boat in the water; and inflating a tube extending from a bow of the boat to a stern of the boat along opposite sides.

14. The method claimed in claim 13, wherein the tube is inflated by an air supply device within the aircraft.

15. The method claimed in claim 13, wherein the tube is inflated by an air supply device within the boat.

16. The method claimed in claim 13, wherein the tube is inflated by an air pump on the boat.

17. The method claimed in claim 13, further comprising the subsequent steps of:

driving the boat to at least one person in need of rescue; and placing said at least one person into the boat.

18. The method claimed in claim 17, further comprising the subsequent steps of:

driving the boat back to the aircraft; and depositing the at least one person into the aircraft.

19. A foldable boat comprising:

a first rigid hull section having a bottom that is substantially V-shaped in transverse section, the first rigid hull section defining a longitudinal axis from bow to stern;

at least one second rigid hull section hinged to the first rigid hull section, wherein an axis of rotation therebetween runs longitudinally with respect to the boat;

a third rigid hull section hinged to the first rigid hull section, wherein an axis of rotation therebetween runs longitudinally with respect to the first hull section, wherein the third section is mounted on an opposite side of the first section from the second hull section such that the first section forms a center section and the second and third sections respectively form port and starboard sections, the second and third sections respectively forming upper edges of the V-shape; and a plurality of hinges between the first hull section and the second and third hull sections, wherein the hinges permit the second and third hull sections to be folded from an unfolded state upward and inward into a folded state, thereby significantly reducing the storage width of the boat relative to the unfolded state, wherein the second and third hull sections are disposed above the first section when in the folded state.

20. A foldable boat comprising:

a first rigid hull section having a bottom that is substantially V-shaped in transverse section, the first rigid hull section defining a longitudinal axis from bow to stern;

at least one second rigid hull section hinged to the first rigid hull section, wherein an axis of rotation therebetween runs longitudinally with respect to the boat;

a third rigid hull section hinged to the first rigid hull section, wherein an axis of rotation therebetween runs longitudinally with respect to the first hull section, wherein the third section is mounted on an opposite side of the first section from the second hull section such that the first section forms a center section and the second and third sections respectively form port and starboard sections, the second and third sections respectively forming upper edges of the V-shape;

a plurality of hinges between the first hull section and the second and third hull sections, wherein the hinges permit the second and third hull sections to be folded from an unfolded state upward and inward into a folded state, thereby significantly reducing the storage width of the boat relative to the unfolded state; and at least one latching mechanism for locking the second and third hull sections to the first hull section in the unfolded position.

21. A foldable boat comprising:

a first rigid hull section having a bottom that is substantially V-shaped in transverse section, the first rigid hull section defining a longitudinal axis from bow to stern;

at least one second rigid hull section hinged to the first rigid hull section, wherein an axis of rotation therebetween runs longitudinally with respect to the boat;

a third rigid hull section hinged to the first rigid hull section, wherein an axis of rotation therebetween runs longitudinally with respect to the first hull section, wherein the third section is mounted on an opposite side of the first section from the second hull section such that the first section forms a center section and the second and third sections respectively form port and starboard sections, the second and third sections respectively forming upper edges of the V-shape; and an automatic folding device that automatically folds the second and third sections from the unfolded state into the folded state.

* * * * *